US005518493A

United States Patent [19]

Srinivasan

[11] Patent Number: 5,518,493

[45] Date of Patent: May 21, 1996

[54] AUTOMATIC ROTOR IDENTIFICATION BASED ON A ROTOR-TRANSMITTED SIGNAL

[75] Inventor: Krupa S. Srinivasan, Sunnyvale, Calif.

[73] Assignee: Beckman Instruments, Inc., Fullerton, Calif.

[21] Appl. No.: 271,174

[22] Filed: Jul. 7, 1994

[51] Int. Cl.[6] ..... B04B 15/00

[52] U.S. Cl. ..... 494/010; 494/37; 340/671

[58] Field of Search ..... 494/1, 60, 9–11, 494/16, 37; 340/671, 825.54

[56] References Cited

U.S. PATENT DOCUMENTS

| | | | |
|---|---|---|---|
| 4,551,715 | 11/1985 | Durbin | 340/671 |
| 4,601,696 | 7/1986 | Kamm | 494/10 |
| 4,700,117 | 10/1987 | Giebeler et al. | 340/671 X |
| 4,772,254 | 9/1988 | Grassl et al. | 494/10 |
| 4,818,855 | 4/1989 | Mongeon et al. . | |
| 4,960,406 | 10/1990 | Gorodissky et al. | 494/9 |
| 5,037,371 | 8/1991 | Romanauskas | 494/10 |
| 5,099,227 | 3/1992 | Geiszler et al. | 340/572 |
| 5,198,807 | 3/1993 | Troyk et al. | 340/825.54 |
| 5,211,129 | 5/1993 | Taylor et al. . | |
| 5,221,250 | 6/1993 | Cheng | 494/10 |
| 5,235,864 | 8/1993 | Rosselli et al. | 73/865.9 |
| 5,338,283 | 8/1994 | Fleming et al. | 340/671 X |
| 5,382,218 | 1/1995 | Uchida | 494/10 |

*Primary Examiner*—Charles E. Cooley
*Attorney, Agent, or Firm*—William H. May; Paul R. Harder; Schneck & McHugh

[57] ABSTRACT

A centrifuge system and method includes generating a radio frequency excitation field within a housing containing a rotor of interest. The excitation field may be generated by an exciter coil fixed to the cover of the housing. The rotor includes a locking knob that encloses a receiver coil inductively coupled to the exciter coil. The excitation field causes current flow through the receiver coil. The current is rectified and used to power encoding circuitry. The encoding circuitry produces a modulated signal unique to the rotor or to a model in which the rotor is classified. The encoded signal is transmitted from within the locking knob to a reader coil connected to the housing of the centrifuge. The reader coil receives the encoded signal, whereafter the signal is decoded and used to identify the rotor or rotor model.

22 Claims, 2 Drawing Sheets

AUTOMATIC ROTOR IDENTIFICATION BASED ON A ROTOR-TRANSMITTED SIGNAL

TECHNICAL FIELD

The present invention relates generally to a centrifuge system and more particularly to a method and system for identifying a centrifuge rotor.

BACKGROUND ART

Centrifugation of a biological or chemical sample in order to separate sample components requires high angular velocities. Generally, increases in angular velocity provide faster and/or more refined separations. A drive system of a centrifuge may be required to spin a sample-containing rotor at 100,000 revolutions per minute.

The drive system of the centrifuge is adapted for interchangeably mounting any of a variety of models of rotors onto a drive shaft. For a particular separation process, a rotor model is selected based upon the physical characteristics of the rotor model. The availability of a variety of types of rotors increases the versatility of the centrifuge in biological and chemical experimental research.

Each rotor model has a rated maximum safe speed, which generally depends upon maximum allowable centrifugally induced stresses. Operation in excess of the speed designed for safe operation of the rotor may lead to a catastrophic rotor failure. Such a failure may result in the rotor disconnecting from the drive shaft or in the rotor disintegrating into pieces. Additionally, a catastrophic rotor failure will typically render the entire centrifuge unusable.

There are a number of different known approaches to identifying rotors within a centrifuge. In a basic approach, the operator must input certain information before operation of the system is enabled. A concern with this approach is that the safeguard is subject to unintentional or intentional misidentification by the operator. Thus, industry regulations require further safeguards.

A second approach to rotor identification is operator independent. The rotor is caused to rotate within the centrifuge and spinning coding elements that are fixed to the rotor are optically read. The coding elements may be fixed to each rotor in a manner unique to the model to which the rotor is identified. A detection device within the centrifuge reads the coding elements and produces a rotor identification signal. Circuitry responsive to the signal ensures that the identified rotor is then maintained at or below the rated maximum safe speed. Coded rotors are described in U.S. Pat. Nos. 4,551,715 to Durbin and 5,221,250 to Cheng, both of which are assigned to the assignee of the present invention.

Indicative of a third approach to rotor identification is U.S. Pat. No. 4,827,197 to Giebeler, which is also assigned to the assignee of the present invention. Like the second approach, this approach is a back-up to the input of rotor ID by an operator. Giebeler teaches that a positive identification of a rotor may be made by calculating the moment of inertia of the rotor. The rotor is accelerated under constant torque. Acceleration from a first speed to a second speed is timed and the moment of inertia is computed by using the calculations of change in speed and change in time. After obtaining the moment of inertia, Giebeler teaches that the positive identification can be made by matching the calculated moment of inertia to a known moment of inertia of one of the rotor models.

U.S. Pat. No. 5,235,864 to Rosselli et al. also teaches using this third approach in which resistance to rotor acceleration is used to identify the rotor. However, instead of calculating moment of inertia, Rosselli et al. teaches using "windage," which is defined as the resistance to rotor motion that is a result of air friction along the surface of the rotor. Rosselli et al. teaches that a step in determining windage is either to measure the time needed to accelerate the rotor from a first relatively high speed to a second higher speed or to select a time period and measure the change in speed within the selected time period. The velocity signal or the time signal generated during this step is then used to generate a rotor identity signal by means of either comparing the signal with a reference signal indicative of a reference windage value or by means of addressing a look-up table of windage values. It is taught that in one embodiment a preliminary decision is made as to whether the rotor lies in the high windage regime or the low windage regime of rotors. However, it is left unclear as to how the decision is to be based. In any embodiment, the determination of windage is achieved by accelerating the rotor at relatively high speeds at which Rosselli et al. teaches that windage becomes dominant to inertia in resisting motion of the rotor.

A number of difficulties with identification schemes of the second approach, i.e., encoded rotors, are set forth in the Rosselli et al. patent. The coding elements and the decoder are located within the centrifuge and are subject to corrosion, which would adversely affect the ability of the system to accurately identify rotors. Moreover, it would not be possible to identify rotors that are not equipped with the coding elements. Retrofitting the coding elements onto pre-existing rotors or limited-use rotors would render the system susceptible to accidental or deliberate mismarkings.

U.S. Pat. No. 5,037,371 to Romanauskas describes an approach in which a transmitter emits a pulse of interrogating energy. The pulse is reflected by the rotor and is sensed by a receiver. The transmitter and receiver cooperate to generate a signature signal, or a signature signal pattern, based upon the distance traveled by the pulse of interrogating energy. The distance corresponds to the distance between the receiver and at least one, but preferably more than one, point on the surface of the rotor. Based upon the signature signal, an indicator signal is generated to represent the identity of the rotor. Using this approach, the rotor can be identified prior to rotation of the rotor. However, there are difficulties associated with this approach. Firstly, two rotor models may not be distinguishable if the rotors have basically the same dimensions. Secondly, because the transmitter and the receiver are located within the centrifuge, these elements are susceptible to sample spillage and other contaminants that enter the centrifuge housing. Moreover, the transmitter and receiver are fixed in place, so that designing rotors to predictably reflect the pulses of energy becomes an issue.

An object of the present invention is to provide a system and method for accurately identifying a stationary centrifuge rotor, wherein the equipment used for identification is protected from contaminants and the like.

SUMMARY OF THE INVENTION

The above object has been met by a centrifuge system and method in which a rotor includes a transmitter which emits a rotor-identification signal when the rotor is rotatably mounted within a centrifuge. In a preferred embodiment, the transmitter of the rotor receives power from a source that is external to the rotor.

A first transmitter is energized by drive circuitry to generate a low-level radio frequency magnetic field within a housing of a centrifuge. The rotor within the housing includes a receiver inductively coupled to the first transmitter. Thus, current flows through the receiver within the rotor in response to the radio frequency magnetic field. The current flow is used to power a second transmission. The second transmission is from an identification tag that emits a modulated signal that contains digital information representative of a rotor identification signal. The rotor-identification signal is unique to either the rotor or the model in which the rotor is classified.

Circuitry connected to the centrifuge housing receives the modulated signal from the receiver/transmitter i.e., "transceiver" of the rotor. The modulated signal is demodulated by reader electronics to obtain the rotor-identification signal. The rotor-identification signal can then be compared to previously stored information to specify the rotor mounted within the centrifuge.

In a preferred embodiment, the receiver/transmitter of the rotor is contained within a knob that is transparent to the excitation signal generated by the first transmitter. The knob is located at a top surface of the rotor and includes an externally threaded member for fixing the rotor to a drive shaft of the centrifuge. The receiver/transmitter is sealed within the knob to protect the circuitry from contaminants.

The first transmitter in the reader circuitry is attached to the centrifuge housing in a position that ensures proper communication between the rotor and the first transmitter/reader. Consequently, the first transmitter/reader may be referred to as the "first transceiver" and the receiver/transmitter of the rotor may be referred to as the "second transceiver". The first transmitter and the reader may be mounted within a centrifuge door. An exciter coil may be mounted within the door to the outside of a reader coil. The identification process is activated when the centrifuge system is powered and the rotor is in the field generated by the first transmitter.

An advantage of the present invention is that rotor identification occurs prior to rotation of the rotor. That is, the method does not require motion of the rotor. This eliminates "line of sight" problems often associated with optical identification schemes. Moreover, since the transmitters and the receivers are sealed relative to the interior of the centrifuge housing, the electronics is protected. Retrofitting existing rotors is achieved merely by replacing the knobs of the rotors with knobs equipped to include the receiver/transmitter electronics.

BEST MODE FOR CARRYING OUT THE INVENTION

Figure 1:
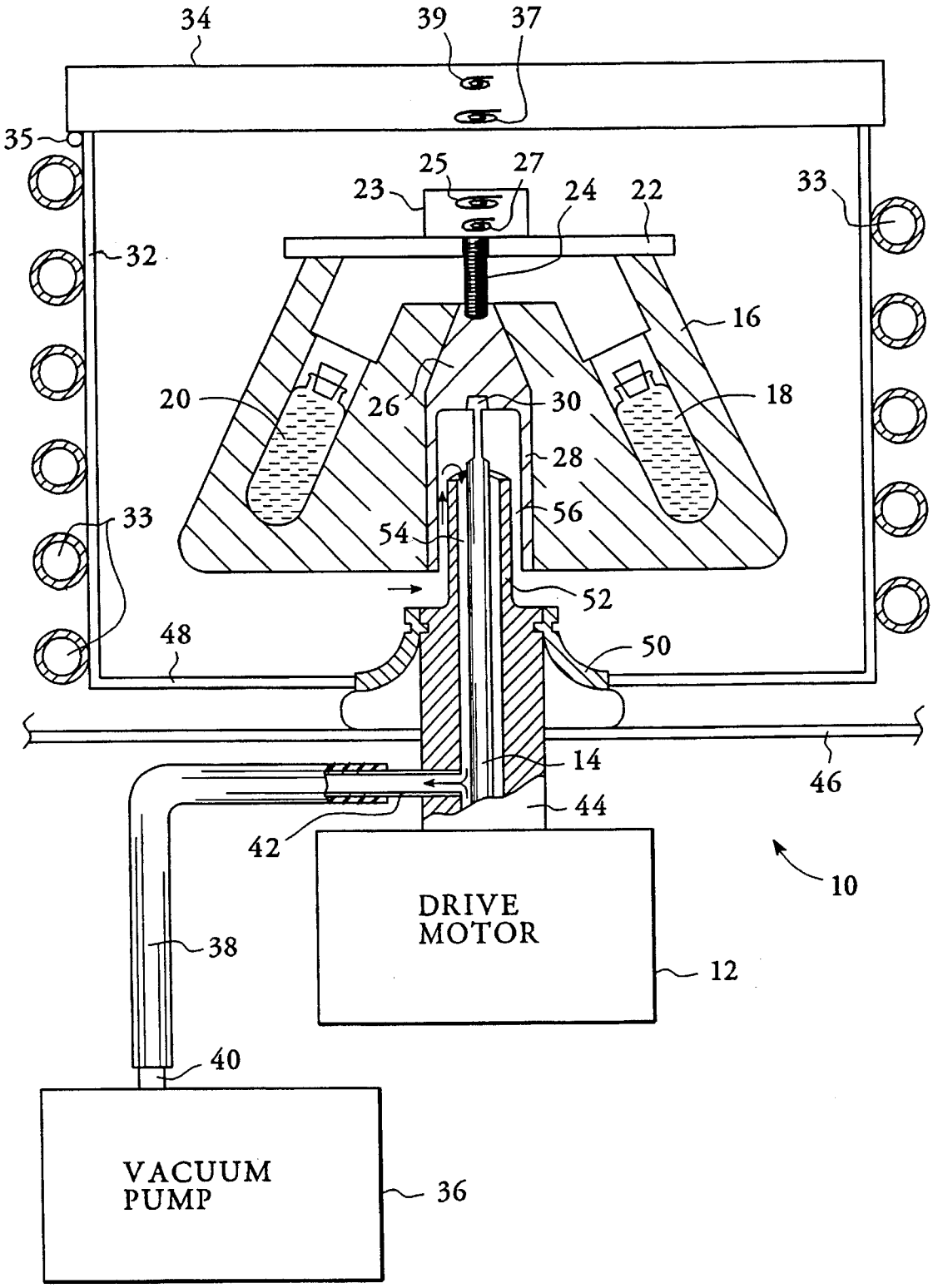
FIG. 1 is a side sectional view of a centrifuge having rotor identification apparatus in accordance with the invention.

With reference to FIG. 1, a centrifuge 10 includes a drive motor 12 for rotating a drive shaft 14. While not critical, the drive motor may be a switched reluctance motor manufactured by Switched Reluctance Drives Ltd. The drive motor may be of the type to drive a rotor 16 at a rate as great as 100,000 revolutions per minute.

The rotor 16 is shown as having compartments for securing at least two specimen containers 18 and 20 for the centrifugal separation of specimen components. The containers 18 and 20 are placed in the rotor by removing a rotor lid 22. A locking knob 23 includes an externally threaded bolt 24 that extends through a hole in the rotor lid and is received within an internally threaded bore of a hub 26. The bolt secures the rotor lid 22 to the rotor 16 and secures the rotor to the hub. As will be explained fully below, the locking knob houses a receiver coil 25 and a transmitter coil 27, but the receiver coil 25 may optionally also function as the transmitter coil.

The hub 26 has a cylindrical, downwardly depending skirt 28. The hub is fixed to the upper end of the drive shaft 14 such that the cylindrical skirt is coaxial to the drive shaft. The rotational drive of the motor 12 is transferred to the rotor 16 by means of the drive shaft 14 and the hub 26. The upper end 30 of the drive shaft may be secured to the hub using conventional techniques. The rotor has an internal surface configured to receive the hub 26.

The rotor 16, the hub 26 and the upper portion of the drive shaft are contained within a chamber defined by a housing 32 having a cover 34. While not shown, typically vacuum seals are located at the interface of the cover with the remainder of the housing. The side walls and the bottom wall of the housing 32 may be a metallic framework having refrigeration coils 33 at exterior surfaces to control the temperature within the enclosed chamber defined by the housing.

The cover 34 is connected to the remainder of the housing 32 by a hinge 35. Contained within the cover 34 are an exciter coil 37 and a reader coil 39. While the coils 37 and 39 are shown in spaced relationship, the exciter coil and the reader coil are typically coplanar and concentric. The exciter coil 37 is larger and encircles the reader coil 39. This relationship functions to minimize coupling between the two coils, since electromagnetic coupling would degrade the performance of the rotor identification system. In like manner, the transmitter coil 27 within the locking knob 23 is coplanar to and preferably concentric with the larger receiver coil 25 for embodiments which utilize separate transmitter and receiver coils.

In addition to temperature control, the atmosphere within the enclosed chamber of the housing 32 may be controlled by operation of a vacuum pump 36. A conduit 38 is connected to a fitting 40 that extends from the vacuum pump. At the opposite end of the conduit, the conduit is frictionally fit to a fitting 42 of a sleeve 44. The sleeve 44 has a lower, larger diameter portion that extends coaxially with the drive shaft 14 to penetrate openings in an outer framework 46 and the bottom wall 48 of the housing 32. A vacuum seal 50 connects the bottom wall to the sleeve 44 to prevent leakage of air into the enclosed chamber of housing 32 after the evacuation of air from the housing.

A reduced diameter portion 52 of the sleeve 44 extends into the downwardly depending skirt 28 of the hub 26. Thus, a first annular gap 54 is formed between the drive shaft 14 and the inner surface of the sleeve 44. A second annular gap 56 is formed between the downwardly depending skirt 28 of the hub and the outside diameter of the portion 52 of the sleeve 44.

Air evacuation from the centrifuge chamber is upwardly into the second annular gap 56 and then downwardly into the first annular gap 54, whereafter evacuated air is channeled to the vacuum pump 36. As shown in FIG. 1, the motor 12 is also evacuated.

Figure 2:
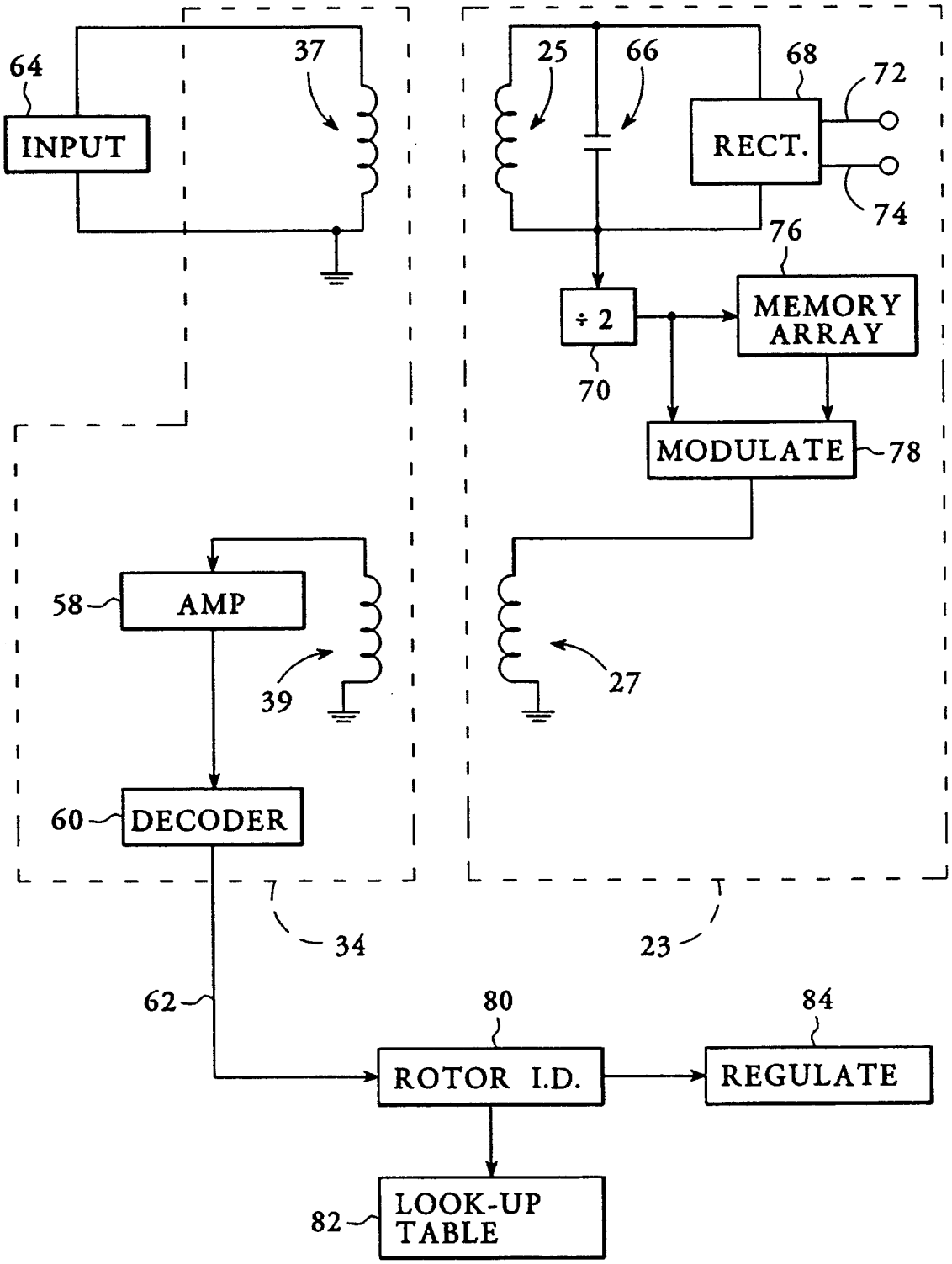
FIG. 2 is a block diagram of the rotor identification system of FIG. 1.

Referring now to FIG. 2, circuitry within the locking knob 23 and the cover 34 provides a radio frequency (RF) identification system for recognizing the rotor to which the knob 23 is attached. The system provides an accurate identification without requiring motion of the rotor.

The exciter coil 37 and the reader coil 39 are housed within the cover 34. An amplifier 58 and a decoder 60 are shown as being within the cover, but the amplifier and decoder are preferably located on a reader board. Signals exit the cover via a flexible, shielded cable and a standard RS232 interface to control head circuitry of a centrifuge. A signal input 64 is also located in the control head and is connected to the exciter coil 37 by means of the shielded cable.

The circuitry shown in FIG. 2 as being housed within the locking knob 23 is passive circuitry in the absence of current flow through the exciter coil 37 of the cover 34. Inductive coupling of the exciter coil 37 and the receiver coil 25 activates a "tag" to generate a coded signal from the transmitter coil 27 to the reader coil 39. The tag assembly is sold by Indala Corporation as part number IT-54E, with the antenna assembly within the cover and cable sold as IA-BISD-50E and the remote electronics, e.g., the amplifier 58 and decoder 60 sold as IRE-BISD-50E. Such devices are described in U.S. Pat. Nos. 4,818,855 to Mongeon et al. and 5,099,227 to Geiszler et al. Teachings in Geiszler et al. include utilizing receiver coil 25 to also act as the transmitter coil 27. The patent teaches that a coded data signal can be coupled to the high side of a receiver coil by a capacitor, transistor or resistor/diode arrangement in order to transmit the signal to a reader coil via electromagnetic coupling. Consequently, the transmission coil 27 of FIG. 2 is not a critical element of the rotor identification circuitry.

The signal input 64 generates a frequency of 125 KHz, or some other suitable low-level, low radio frequency signal to the exciter coil 37. The exciter coil emits an electromagnetic field into the housing of the centrifuge. Because the receiver coil 25 is positioned within the electromagnetic field, current is caused to flow through the receiver coil. In the four-coil embodiment of FIG. 2, the capacitor 66 is selected to form a tuned circuit with the inductance of the receiver coil to provide a strong coupling with the exciter coil 37.

The input 64 is connected to the exciter coil 37, but the exciter coil is inductively coupled to the receiver coil 25 only when the cover 34 is moved to a closed position. The receiver coil 25 acts as an antenna, with current flow being channeled both to a rectifier 68 and a divide-by-two circuit 70. The rectifier 68 provides a DC voltage across lines 72 and 74 for operation of the electronic devices within the divide-by-two circuit 70, a memory array 76 and a modulator 78. For example, the voltage across the lines 72 and 74 may be 5 VDC, 12 VDC, or 24 VDC.

The divide-by-two circuit 70 reduces the input frequency by a factor of two. In the preferred embodiment, the input frequency of 125 KHz is reduced to 62.5 KHz. The output of the divide-by-two circuit 70 provides a clock signal to the modulator 78 and also addresses the memory array 76.

The memory array 76 is programmed to generate a code that is unique to either the rotor to which the locking knob 23 is attached or to the model to which the rotor is identified. While not critical, the memory array may be a programmable read-only-memory (PROM) device. The modulator 78 receives a gate signal from the divide-by-two circuit 70 and receiver coded pulses from the memory array 76. The output of the modulator is connected to the transmitter coil 27. In its simplest form, the modulator is an AND gate that modulates the square wave signal from the circuit 70 in accordance with the coded pulses from the memory array 76.

The coded output from the modulator 78 is transmitted to the reader coil 39 by means of inductive coupling. While not shown, the reader coil includes components which tune the coil to the clock frequency of the divide-by-two circuit 70. The amplifier 58 then raises the strength of the coded signal. Typically, the signal strength from the reader coil 39 is sufficient to allow the amplifier 58 and the decoder 60 to be located at the end of the shielded cable 62 opposite to the cover 34. That is, the amplifier and the decoder are typically formed on a reader board in the control head of the centrifuge.

The decoder 60 reads the signal received by the reader coil 39. The output of the decoder is a signal that is representative of the rotor or the rotor model. As will be readily understood by persons skilled in the art, the operation of the decoder 60 is dependent upon the mechanism for encoding the signal transmitted by the transmitter coil 27. Phase shift keying is to encode the signal. Frequency modulation, amplitude modulation and phase modulation are possible approaches to encoding a signal in accordance with code contained within the memory array 76.

Within the control head of the centrifuge is circuitry 80 that receives the decoded signal from the decoder 60 and identifies the rotor or rotor model. The data to the control head is transmitted from the decoder in an ASCII string of eleven characters, seven decimal digits, two checksum digits, and a terminating <CR> and <LF>. The baud rate is 300 baud. Each character includes one start bit, eight data bits, one stop bit and no parity. There is no hardware handshaking. Identification circuitry 80 may be connected to a look-up table 82 having memory for storing coded identifications of each rotor or rotor model. Alternatively, the identification circuitry may be connected to a source of reference signals, so that a comparison between the signal along cable 62 reference signals is used to identify the rotor or rotor model.

The rotor identification is designed as an alternative to requiring an operator to manually input an identifier. However, it may be possible to connect the identification circuitry 80 to regulating circuitry 84 to control run parameters based upon the identification. That is, information obtained from circuitry 80 and look-up table 82 may be extended to assist in control of rotor speed, refrigeration and vacuum. As another option, the information may be utilized to maintain a log for each rotor. A centrifuge rotor has a limited useful life, and maintaining the log will allow a user to track the use of the rotor.

In the embodiment of FIG. 2, the coils 25 and 27, or a single coil to be used to both transmit and receive, and the associated circuitry are placed between two molded plastic halves that are then ultrasonically welded to form the locking knob 23. The plastic halves may be injection molded members that provide a hermetic seal when welded together. It is important that the locking knob be formed of a material that is transparent to the transmission of the fields from the exciter coil 37 and the transmitter coil 27. Likewise, the cover 34 should be formed of a material that is transparent to the transmitted fields. However, there is a steel plate located in the cover, above the antenna assembly that includes coils 37 and 39. In another embodiment, the coils 37 and 39 are attached to the cover 34, rather than being embedded within the cover.

Power for operating the system of FIGS. 1 and 2 may be provided by a switching power supply having a regulated voltage of 24 VDC and a current of approximately 300 mA.

The encoding of the signal transmitted by the transmitter coil 27 may be in the form of a 32-bit word, providing capacity for identification of a large number of different rotors or rotor models.

While the invention has been described as identifying the centrifuge rotor prior to initiating rotation of the rotor, the identification circuitry is functional when the rotor is spun at a slow speed. Thus, if desired, the identification can occur while the rotor is rotated.

What is claimed is:

1. A centrifuge system comprising:

a housing;

drive means for rotatably mounting a rotor within said housing;

a first transceiver connected to said housing, said first transceiver having power-supplying means for generating an excitation field into said housing and having reader means for receiving and recognizing a rotor-identification signal;

at least one rotor, said at least one rotor being connected to said drive means; and at least one second transceiver, said at least one second transceiver being fixed to said rotor, said at least one second transceiver having a power-receiving means within said excitation field for deriving power in response to said excitation field and an identifier means for radiating said rotor-identification signal indicative of said rotor to said reader means, said identifier means including means for storing said rotor-identification signal.

2. The system of claim 1 further comprising memory means, connected to said reader means, for storing data relating said at least one rotor to a code uniquely associated therewith.

3. The system of claim 1 wherein said power-supplying means of said first transceiver is inductively coupled to said power-receiving means of said at least one second transceiver.

4. The system of claim 1 further including a plurality of rotors and a plurality of second transceivers, with each of the plurality of second transceivers uniquely associated with, and fixed to, one of said plurality of rotors, each of said plurality of second transceivers having memory means for storing a rotor-identification signal indicative of the rotor associated therewith, each of said plurality of second transceivers having power-receiving means responsive to said excitation field and having an identifier means for transmitting said rotor-identification signal, and a memory means, connected to said reader means, for storing data relating each of said plurality of rotors to a unique code.

5. The system of claim 1 wherein said at least one rotor includes a knob, said at least one second transceiver being secured to said knob.

6. The system of claim 5 wherein said knob is formed of a material transparent to said excitation field.

7. The system of claim 5 wherein said first transceiver is attached to a door of said housing.

8. A system for identifying a stationary centrifuge rotor comprising:

a centrifuge having a fixed structure and having drive means;

means, attached to said fixed structure, for radiating an excitation field;

a plurality of rotors formed to be connected to said drive means, each rotor having power-supplying means positioned within said excitation field when said each rotor is connected to said drive means for establishing a supply voltage in response to said excitation field;

identifier means, attached to each of said plurality of rotors and connected to be powered by said supply voltage, for emitting a coded signal, with the identifier means of each of said plurality of rotors having memory for storing a coded signal representative of the rotor to which the identifier means is attached;

reader means, attached to said fixed structure, for receiving said coded signal emitted from the identifier means of one of said plurality of rotors connected to said drive means; and means responsive to said reader means for distinguishing said one of said plurality of rotors connected to said drive means based upon said coded signal.

9. The system of claim 8 wherein each of said plurality of rotors includes a knob at an upper end thereof, said knob housing said power-supplying means and said identifier means.

10. The system of claim 9 wherein said knob is substantially transparent to radiating electromagnetic fields, said power-supplying means and identifier means being embedded within said knob.

11. The system of claim 8 wherein said coded signal includes digital information indicative of one of said plurality of rotors.

12. A method of identifying a centrifuge rotor comprising:

radiating an electromagnetic field into a housing of a centrifuge system;

utilizing said electromagnetic field to derive a supply of power for driving circuitry attached to a rotor rotatably supported within said housing;

radiating a coded rotor-identification signal from said rotor by means of said circuitry driven by said supply of power;

receiving said radiated coded rotor-identification signal;

reading said received coded rotor-identification signal; and based upon said reading, obtaining data relating to identification of said rotor.

13. The method of claim 12 wherein said step of obtaining data is a step of addressing a look-up table having data specific to said rotor.

14. The method of claim 13 further comprising regulating operation of said centrifuge system based upon said data obtained from said look-up table.

15. The method of claim 12 wherein said step of utilizing said electromagnetic field includes inductively coupling a transmitter fixed to said housing with a receiver fixed to said rotor.

16. The method of claim 12 wherein said step of radiating said coded rotor-identification signal occurs prior to rotating said rotor.

17. The method of claim 12 wherein said step of radiating said coded rotor-identification signal occurs subsequent to rotating said rotor.

18. A centrifuge rotor mountable to a centrifuge drive system connectible to a plurality of different rotors comprising:

a rotor body;

means for supporting said rotor body to allow a sample, disposed in said rotor body, to be separated under centrifugal force; and identification means, fixed to said means for supporting, for transmitting a coded signal in response to receiving an excitation signal from an external source.

19. The centrifuge rotor of claim 18 wherein said identification means includes rectifier circuitry for converting said excitation signal to a d.c. voltage, said identification means further including memory for storing said coded signal, said memory being in electrical communication with said rectifier circuitry to generate said coded signal in response to said excitation signal.

20. The centrifuge rotor of claim 18 further comprising a knob fixed to said means for supporting, said identification means being housed within said knob.

21. A centrifuge comprising:

a centrifuge rotor;

means for supporting said rotor to allow a sample, disposed in said rotor, to be separated under centrifugal force;

a housing defining a centrifuge chamber;

a transmitter having means for radiating an excitation field into said centrifuge chamber, said transmitter being connected to said housing;

identification means, fixed to said means for supporting, for transmitting a coded signal in response to sensing said excitation field;

a reader having means for receiving a coded signal from said centrifuge chamber, said reader being connected to said housing; and decoder means for recognizing said coded signal received by said reader as an identification of said centrifuge rotor within said centrifuge chamber.

22. The centrifuge of claim 21 further comprising memory means for storing a data related to identifying a plurality of coded signals representative of different centrifuge rotors.

* * * * *